United States Patent [19]

Itoi

[11] 4,268,076

[45] May 19, 1981

[54] CASH BOX PROVIDED WITH A TILL

[75] Inventor: Toshihiro Itoi, Tokyo, Japan

[73] Assignee: Kabushiki Kaisha Itoi Seisakusho, Tokyo, Japan

[21] Appl. No.: 59,622

[22] Filed: Jul. 23, 1979

Related U.S. Application Data

[63] Continuation of Ser. No. 870,292, Jan. 18, 1978, abandoned.

[30] Foreign Application Priority Data

Sep. 27, 1977 [JP] Japan ..... 52-129495

[51] Int. Cl.[3] ..... E05C 3/06

[52] U.S. Cl. ..... 292/216; 70/279; 70/87; 312/222; 312/333; 292/201

[58] Field of Search ..... 70/85, 87, 88, 256, 70/279, 282; 292/216, 201; 312/222, 333

[56] References Cited

U.S. PATENT DOCUMENTS

| | | | |
|---|---|---|---|
| 1,926,809 | 9/1933 | Jacobson | 70/88 |
| 3,504,511 | 4/1970 | Allen | 70/241 |
| 3,664,698 | 5/1972 | Stropkay | 292/216 |
| 3,666,342 | 5/1972 | Biesecker | 312/333 |
| 3,804,441 | 4/1974 | Kobayashi et al. | 292/216 |

*Primary Examiner*—Kenneth Dorner

*Attorney, Agent, or Firm*—Charles R. Hoffmann

[57] ABSTRACT

A cash box provided with a till comprises a cash box, a till which can be slidably taken in and out of said cash box and is provided with an engage body on its rear end portion, a base plate fitted within said cash box, an electromagnetic means provided on said base plate, a frame plate on which, one end portion is provided with a projection and on which another end portion is connected with a movable rod of said electromagnetic means and rotatably supported by a shaft on said base plate, and a plate cam on which peripheral portion is provided with an engage groove and an engage projection and which is rotatably supported by a shaft on said base plate so that said engage body is engaged with and disengaged from said engage groove and said engage projection is engaged with and disengaged from said projection. When said engage body is engaged with said engage groove of said plate cam, the engagement between the projection of said frame plate and the engage projection makes said plate cam unrotatable to lock the till within the cash box, while the frame plate is rotated by the electromagnetic means connected with the switch means to release said engagement so that said engage body is pushed by the wall portion of said engage groove, thus enabling the till to be drawn out automatically.

3 Claims, 6 Drawing Figures

CASH BOX PROVIDED WITH A TILL

This is a continuation of application Ser. No. 870,292, filed Jan. 18, 1978, and now abandoned.

BACKGROUND OF THE INVENTION

Heretofore, drawer means for a cash box provided with an electromagnetically operated ratch lock have been proposed. These means comprising a cash box and a till which can be taken in and out of the cash box and provided with an engage portion on the rear end of the till, and an engage means for locking said till through said engage portion and a pressing spring are arranged between the cash box and a rear plate of the till, and an engage means for locking the till is operated by an electromagnetic means connected with a switch means, thus when the engagement is released, the till is automatically drawn out by the pressing force of said pressing spring.

However, said means have had several disadvantages such that the engage means is complicated in its shape and structure, lacking in functional durability, and liable to cause troubles in its maintenance, because those parts such as the pressing spring associated with engage operation acting between the cash box and the till are separately provided from the engage means, and further whole device cannot be made spatially small.

SUMMARY OF THE INVENTION

This invention has been made in the view of the above-mentioned circumstances and is related to a cash box provided with a till for receiving money and the like.

The first object of the invention is to provide such a cash box provided with a till that automatic locking and automatic releasing are possible, the structure thereof is simple, having good durability and function.

The second object of the invention is to provide such a cash box provided with a till that the maintenance thereof is simple, having excellent reliability and safety.

The third object of the invention is to provide such a cash box that it is sufficed with small number of parts and the space for fitting of engage means is made as small as possible to minimize the size of whole cash box.

BRIEF DESCRIPTION OF THE DRAWING

Accompanying drawings show an embodiment of the present invention, wherein.

DETAILED DESCRIPTION OF THE PREFERRED EMBODIMENT

An embodiment of the present invention will be explained on the basis of the accompanying drawings as follows.

Figures 2, 3, 4:
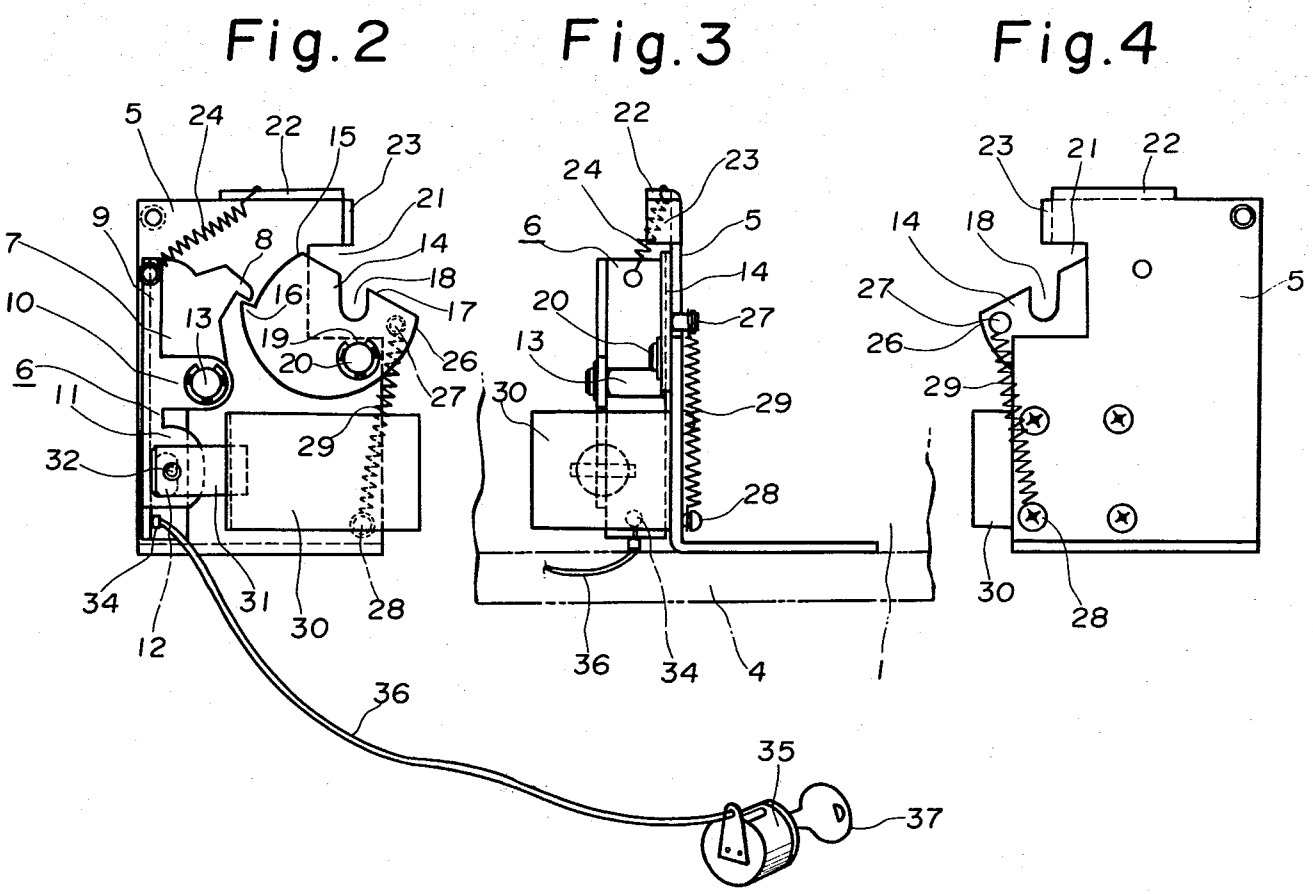
FIG. 2 is a left side view of the main part, showing an engaged state between a projection and an engage projection.
FIG. 3 is a front view of the main part.
FIG. 4 is a right side view of the main part.
Figure 5:
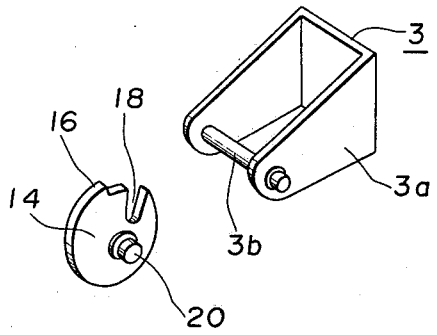
FIG. 5 is a perspective view of the main part.

1 is a cash box, having an opening on a portion of its front surface, through which opening a box shaped till 2 can be slidably taken in and out. On the rear end of the till 2, an engage body 3 is secured, in which tip portions of members 3*a* forming channel shaped cross section are inserted and fixed by an engage rod 3*b*. While, on a bottom plate 4 within the cash box 1, a L-shaped base plate 5 is secured as shown in FIG. 3. On the other hand, a frame plate 6 is formed as follows. Namely, a plate member is formed into channel shape and on one side plate 7 (rear side plate shown in FIG. 2) of side plates 7 and 9, a beak-shaped projection 8 is formed on its right upper portion projecting rightwardly and downwardly inclined as well as its right lower portion being cut out. In another side plate 9 (front side plate shown in FIG. 2) of said channel shape member, its right upper portion is cut out as shown in the drawing and a bearing plate portion 10 is formed at its central portion and a movable rod fitting plate portion 11 is formed at its lower portion respectively, and the latter portion 11 is provided with a vertical oblong hole 12, in which a connecting pin 32 to be mentioned later fitted to the movable rod fitting plate portion 11 is loosely inserted. Central right portion of the side plate 7, tip portion of the bearing plate portion 10 and substantially central portion of the base plate 5 in FIG. 2 of the frame plate 6 formed as mentioned above are inserted by a shaft 13 to rotatably support the frame plate 6 on the base plate 5.

A plate cam 14, which is provided at a position confronting with the side plate 7 of said frame plate 6, is formed as follows. Namely, in FIG. 2, a part of circumference of a substantially semicircular plate, in which the maximum length from the circumference to a chord is larger than the radius, (left upper portion in FIG. 2) is cut out to form a circular arc surface 15 as well as to form engage projection 16. And, at a right side part a little apart from the center of circle of a circular arc surface 17 of said substantially semicircular plate, an engage groove 18 is formed which is making an angle of about 60° to the circular arc surface 17 and being directed downwards. Below this engage groove 18, a rotary shaft hole 19 is provided, and the plate cam 14 is rotatably supported on the base plate 5 in such a manner that a shaft 20 is inserted through said rotary shaft hole 19 at a right edge central portion of the base plate 5.

On the right upper portion of the base plate 5 located on rear side of the plate cam 14, a rectangular recess 21 is formed, so that when the till is moved to fit the engage rod 3*b* of said engage body 3 in said engage groove 18, its movement would not be disturbed. And, the right upper edge portion of the base plate 5 is bent to the side of the plate cam 14 to form bent upper edge portions 22 and 23. The left portion of this edge portion 22 and the left upper portion (shown in FIG. 2) of the frame plate 6 are spanned by a spring 24 so as to pull the upper portion of the frame plate 6 towards the side of the plate cam 14. As shown in FIG. 2, a pin 27 is provided at a portion where the circular arc surface 17 of the plate cam 14 and the circumferential surface 25 are joined together, and a spring 29 is spanned between said pin 27 and a fixing screw 28 screwed on the right lower portion of the base plate 5 so as to rotate the cam plate 14 around the shaft 20 as a fulcrum for rotation in the clockwise direction in FIG. 2. The engage projection 16 formed on said plate cam 14 and the projection 8 formed are mutually kept under the state of engagement due to the action of the springs 24 and 29. By the way, below said cam plate 14, a solenoid 30 is fixed to the base plate 5 with its core put in horizontal direction, and a movable rod 31 of said solenoid 30 is connected with the movable rod fitting plate portion 11 by means of said connecting pin 32 loosely inserted in the vertical oblong hole 12 which is provided on the fitting plate portion 11 of the side plate 9 of said frame plate 6. Said frame plate 6 and said plate cam 14 are located under such a relative position that when the plate cam 14 is rotated forward and backward around the center of the shaft 20, the engage projection 16 can be engaged and disengaged with the projection 8 accompanying the operation of said solenoid 30. And, in FIG. 2, it is so arranged that when the cam plate 14 rotates in the clockwise direction, the engage projection 16 disengages from the projection 8 and the engage projection 16 abuts against the bent upper edge portion 23 from the side of the frame plate 6 to stop the rotation of the plate cam 14. The tip portion of lead wires 33 of said solenoid 30 is connected with an electric source through a switch (not shown), according to which ON and OFF the solenoid 30 can be operated.

On a lower portion of the frame plate 6, a key locking means 34 is fitted having relation to the base plate 5, and said means 34 is connected with a key receiver 35 attached to the cash box 1 by means of an operating wire 36, said key locking means 34 is provided to fit the purpose that in case of electricity stoppage or emergency, a key 37 is inserted into the key receiver 35 and by turning the key 37, the frame plate 6 is operated by the operating wire 36 through the key locking means 34 to release the engagement between the projection 8 and the engage projection 16, thus to automatically open the till 2.

The operation of thus constructed cash box will be explained as follows.

Figure 1:
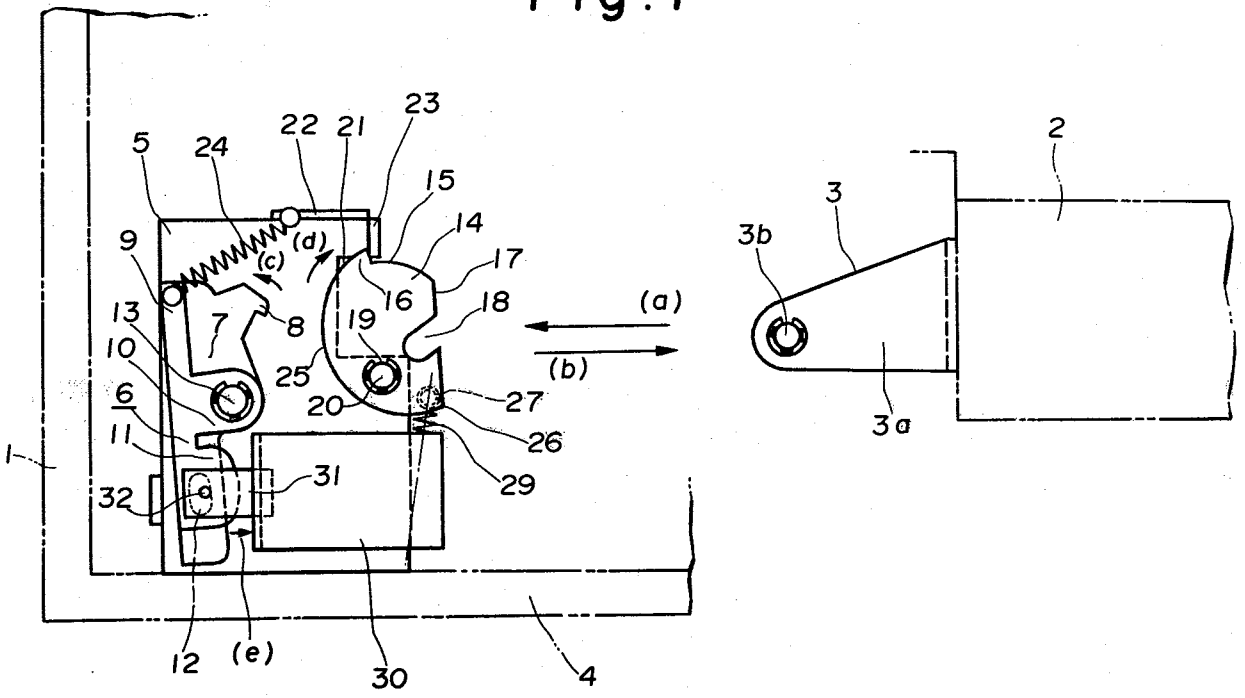
FIG. 1 is an explanatory side view when a till is taken in and out for locking and unlocking.

As shown in FIG. 1, under the state that the till 2 is drawn out from the cash box 1 in the direction of an arrow (b), the plate cam 14 rotates in the clockwise direction around the center of the shaft 20 by the tensile force of the spring 29 and the engage projection 16 is engaged to stop on the bent upper edge portion 23. At this moment, the frame plate 6 is under the state that the core of the solenoid 30 is drawn out by the connecting pin 32 through the vertical oblong hole 12 to cut off the electric source of the solenoid 30, and by the action of the spring 24, the frame plate 6 is rotated in the clockwise direction around the center of the shaft 13 and the upper portion of the frame plate 6 is pulled nearer to the side of the plate cam 14. Now, when the till 2 is pushed into the cash box 1 from this state, namely in FIG. 1 the till 2 is pushed in the direction of an arrow (a), the engage rod **3*b* of the engage body 3 is inserted into the engage groove 18, thus the plate cam 14 is rotated in the anti-clockwise direction around the center of the shaft 20 to make the circumferential surface 25 of the engage projection 16 abut against upper surface of the projection 8, successively pushing the frame plate 6 against the action of the spring 24 to rotate the frame plate 6 in the anti-clockwise direction around the center of the shaft 13, thus to make the engage projection 16 enter in the lower portion of the projection 8**, resulting in a state of engagement.

Figure 6:
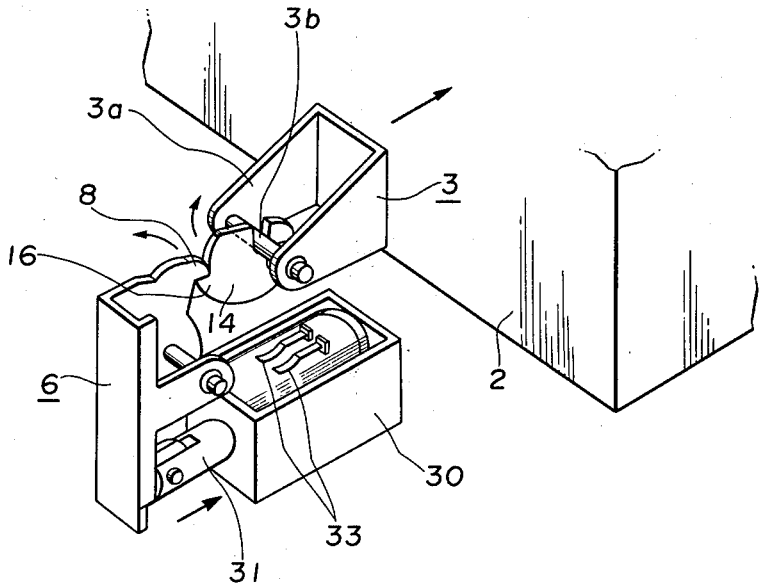
FIG. 6 is a perspective view, showing an engaged state between the projection and the engage projection.

As shown in FIG. 6, even though the till 2 is to be drawn out from the cash box 1, it cannot be released therefrom because of the engage projection 16 being engaged with the projection 8, and because the plate cam 14 is put under unrotatable state, the engage rod **3*b* of the engage body 3 cannot be released from the engage groove 18. So that, under these state, the till 2 cannot be drawn out from the cash box. In this way, the till 2 is locked merely by pushing the till 2 into the cash box 1**.

In the next place, when the till 2 locked in the cash box 1 is to be drawn out, the solenoid is energized by operating the switch connected with said electric source, then the movable rod 31, which being a movable iron core, is attracted into the solenoid 30 in the direction of an arrow (e) by its magnetic action, thus to pull the frame plate 6 in the anti-clockwise direction (shown by an arrow (c)) against the force of the spring 24, so that the engagement between said projection 8 and said engage projection 16 is released. While, at this moment, the plate cam 14 is rotated by the action of the spring 29 around the center of the shaft 20 in the clockwise direction (shown by an arrow (d)), so that the engage projection 16 abuts against the bent upper edge portion 23 to be stopped, thus it becomes a state that the engage rod **3*b* may be drawn out from the engage groove 18 at any time. And, at the same time, by the rotational force of said plate cam caused by the action of the spring 29, the engage rod 3*b* is pushed against the wall surface of the engage groove 18 of the plate cam 14 and by this pushing force, the till 2 is automatically and forcibly pushed out in the direction of the arrow (b) in FIG. 1. Then, the till 2 may be easily drawn out from the cash box 1**.

After the till 2 has been drawn out as mentioned above, the electric source of the solenoid 30 is cut off immediately, and the frame plate returns to its initial position. So that, the till 2 is automatically locked in the cash box 1 by merely pushing the former into the latter, and the locking of said till is automatically released by operating the switch of the electric source, thus the till 2 may be easily drawn out from the cash box 1.

Further, when the electric source is detached from the cash box provided with the till or the switch is made detachable and is detached therefrom, the till cannot be drawn out from the cash box, so that it is extremely safe in view of management. And, when the connecting portion of the electric source or the switch is made as a special way of connection, a more safe cash box is provided with a till may be obtained. And, it is more effective in view of safety to use a special electric source (working voltage and the like).

As explained above, the present invention comprises a cash box, a till which can be slidably taken in and out of said cash box and is provided with an engage body on its rear end portion, a base plate fitted within said cash box, a frame plate on which one end portion is provided with a projection and on which another end portion is connected with a movable rod, and rotatably supported by a shaft on said base plate, a plate cam on which peripheral portion is provided with an engage groove and an engage projection and which is rotatably supported by a shaft on said base plate so that said engage body is engaged with and disengaged from said engage groove and said engage projection is engaged with and disengaged from said projection of said frame plate, and an electromagnetic means for operating said movable rod. Accordingly, the till is automatically locked in the cash box by merely pushing the former into the latter, and the locking of said till is automatically released by operating the switch, thus the till may be easily opened. And yet, due to an interlocking operation between a frame plate having a beck-shaped projection and a plate cam having an engage projection to be engaged with and disengaged from said projection and an engage groove as one body, the operation for releasing said locking can disengage said projection from said engage projection slightly and lightly without special resistance and is sure. Since, any pressing spring or the like, which was usually arranged between the cash box and the till, the device can be made spatially small, and maintenance thereof is easily done, and in addition, by detaching the cash box provided with the till from the electric source or the automatic operating switch is made detachable and detaching the same, management of the till may be simply and safely effected, and so forth, thus the device is trustworthy. And, by making the connecting portion of the electric source or the switch of the cash box provided with the till as a special way of connection, or by using special electric source, still more safe cash box provided with a till may be provided.

What is claimed is:

1. A cash box provided with a till, comprising in combination;

a cash box, a till slidable into and out of the cash box and provided with an engage body on the rear end of the till, the engage body having members forming a channel, the members being inserted and fixed on an engage rod, an L-shaped base plate uprightly secured on a bottom plate within the cash box, a frame plate formed into a channel-shape having side plates, one of the side plates being formed into a beak-shaped projection on its right upper portion and being cut out on its right lower portion, the other of said side plates being cut out on its right upper portion and having a bearing plate formed at its central portion to be rotatably supported by a shaft on said base plate, a movable rod fitting plate portion being formed at the lower portion of said other side plate and connected with a movable rod through a vertical oblong hole in the movable rod fitting plate portion and a connecting pin therein, a plate cam provided with an engage groove and an engage projection on its peripheral portion and being rotatably supported by a shaft on said base plate so that said engage body engages with or disengages from said engage groove to engage or disengage said engage projection with or from said projection of said frame plate, and an electromagnetic means for directly operating said movable rod.

2. The invention in accordance with claim 1 wherein said cash box is provided with a key receiver connected with an operating wire, and said base plate is provided with a key locking means to be operated by a key through said operating wire.

3. The invention in accordance with claim 1 wherein said engage groove has an angular configuration with respect to the direction of travel of the engage body so that as the plate cam rotates and the engage body is disengaged from the engaged groove, the surfaces forming the engage groove will push the engage body from the engage groove to facilitate the automatic and forceable removal of the till from the cash box.

* * * * *